US006150637A

United States Patent [19]

Arroubi et al.

[11] Patent Number: 6,150,637

[45] Date of Patent: Nov. 21, 2000

[54] METHOD FOR CONTROLLING THE DURATION OF HEATING AND/OR COOKING IN AN OVEN AND OVEN FOR IMPLEMENTING THE METHOD

[75] Inventors: Mustapha Arroubi, Villons les Buissons; Lionel Durand, Damblainville, both of France

[73] Assignee: Moulinex S.A., Paris, France

[21] Appl. No.: 09/341,827

[22] PCT Filed: Jan. 15, 1998

[86] PCT No.: PCT/FR98/00074

§ 371 Date: Sep. 2, 1999

§ 102(e) Date: Sep. 2, 1999

[87] PCT Pub. No.: WO98/32311

PCT Pub. Date: Jul. 23, 1998

[30] Foreign Application Priority Data

Jan. 20, 1997 [FR] France ..... 97 00539

[51] Int. Cl.[7] ..... H05B 1/02

[52] U.S. Cl. ..... 219/497; 219/413; 219/492; 99/334; 99/325

[58] Field of Search ..... 219/411–414, 494, 219/497, 492; 99/325–334

[56] References Cited

U.S. PATENT DOCUMENTS

| | | | |
|---|---|---|---|
| 4,370,546 | 1/1983 | Warner | 219/497 |
| 4,918,276 | 4/1990 | Oh . | |
| 4,962,299 | 10/1990 | Duborper et al. | 219/492 |
| 5,352,866 | 10/1994 | Cartwright et al. | 219/497 |
| 5,530,229 | 6/1996 | Gong et al. . | |

FOREIGN PATENT DOCUMENTS

| | | |
|---|---|---|
| 0 098 402 | 1/1984 | European Pat. Off. . |
| 0 248 581 | 12/1987 | European Pat. Off. . |
| 0 497 546 | 8/1992 | European Pat. Off. . |
| 2 621 106 | 3/1989 | France . |

*Primary Examiner*—Mark Paschall
*Attorney, Agent, or Firm*—Young & Thompson

[57] ABSTRACT

The invention concerns a method for controlling the duration of heating and/or cooking an undetermined amount Z of a given food product (5) placed in an oven chamber (1) comprising a heat source (2) and a sensor (4) for picking up a signal characteristic of the heating and/or cooking state of the food product. The invention is characterised in that it consists, after (A) supplying the heat source (2) at an initial moment $t_0$ so that it delivers a predetermined constant power $P_0$, in (B) measuring said characteristic signal at several successive moments over a measuring interval from said initial moment $t_0$ to a final prefixed moment $t_c$; in (C) computing over this measuring interval the value $S_{Zc}$ of the integral of the characteristic signal measurements of taken in absolute value; in (D) deducing the residual time $t_r$ for heating and/or cooking for said undetermined amount Z of food product according to a predetermined polynomial equation linking the residual time $t_r$ to the value $S_{Zc}$ of the computed integral; and in (E) stopping the supply of the heat source when the residual time $t_r$ has elapsed.

10 Claims, 3 Drawing Sheets

METHOD FOR CONTROLLING THE DURATION OF HEATING AND/OR COOKING IN AN OVEN AND OVEN FOR IMPLEMENTING THE METHOD

The present invention relates to a process for controlling the duration of reheating and/or of cooking of an indeterminate quantity Z of a food product of a given type placed in the chamber of an oven comprising a heating source and a detector of a signal characteristic of the state of reheating and/or cooking of the food product.

Numerous methods of automatic control have already been proposed with different types of detectors adapted to measure a particular signal characteristic of the state of reheating and/or cooking of food.

It has particularly been proposed to use a probe insertable directly within the food to measure the internal temperature of this food. In view of the difficulties encountered in certain situations, in particular in the case of frozen foods in which it is impossible to insert the probe, other methods have been developed involving the use of a detector measuring a characteristic signal without requiring physical contact with the food, this detector being for example a detector measuring the atmosphere (temperature or humidity) escaping from the cooking chamber, or else an infrared detector measuring the surface temperature of the food.

French patent FR-2 437 577 discloses an oven in which an infrared detector measures the surface temperature of the food and operates either according to a first control mode in which the heating is stopped as soon as a reference temperature is reached, or according to a second control mode in which the power of the oven is modulated as a function of the measured surface temperature. The modulation of the power consists either in providing successive supply cycles at a fixed power according to interrupted supply, or carrying out a progressive decrease by reducing the power.

The preceding method permits applying energy to the food gently. It is however not ideal when the energy source used is a hyperfrequency source, because it works against the result generally sought in microwave ovens, namely rapidity of cooking.

Moreover, the previous method supposes that the temperature of the food in the course of a reheating and/or cooking operation follows an even upward curve, with little or even no fluctuations, as shown by curve $C_1$ in FIG. 1 showing the theoretical variation of temperature T of a food of a given type as a function of time t. This hypothesis has been found to be wrong in practice, as can be seen from the curve $C_2$ of FIG. 1 representing a real case of variation of temperature T of said food as a function of time t. The observation of this curve shows that an instantaneous measure of temperature is of little significance, particularly in the portion of the curve comprised within the time interval $t_a$ to $t_b$. Thus, within this interval, the time $t_a$ can be recorded as representing the instant at which the reference temperature has been reached, whilst in the absence of fluctuations of the signal (curve $C_1$), the time $t_b$ would be recorded as the time necessary to reach the reference temperature.

There is also known from U.S. Pat. No. 4,812,606 another process for controlling the duration of cooking of a food in a microwave oven in which the temperature of the air in the cooking chamber is measured at a predetermined instance after the beginning of cooking, the residual temperature time is determined from a pre-established polynomial equation in an empirical manner relating the measured time to the residual time, then the supply is stopped when the residual time has passed.

There again, this process is not effective unless it is considered that the temperature undergoes little fluctuation with time, which is not generally the case in practice.

It will thus be easily seen that all the methods relying on the use of an instantaneous measurement of temperature to determine whether the supply from a source of energy should be altered, are hardly reliable.

SUMMARY OF INVENTION

The present invention has for its object a new process for controlling the duration of reheating and/or cooking of an indeterminate quantity Z of food product in an oven which permits solving the problems connected with the fluctuation of the signals characteristic of the state of heating and/or cooking of the product measured by the detector.

More precisely, the process according to the invention is characterized in that it consists in:

- supplying said heating source at an initial instant $t_0$ such that it delivers a constant predetermined power $P_0$;
- measuring said characteristic signal $T_{car}(t)$ at a plurality of successive instants t over a measuring interval extending from said initial instant $t_0$ to a final predetermined instant $t_c$, and computing over this measuring interval the value $S_{Zc}$, of the integral of the measurements of the characteristic signal taken as an absolute value;
- determining the residual time $t_r$ for reheating and/or cooking for said indeterminate quantity Z of food product according to a predetermined memorized polynomial equation connecting said residual time $t_r$ to the value $S_{Zc}$ of the calculated integral, as a function of said type of food product; and
- stopping the supply of the heating source when the residual time $t_r$ has elapsed.

The present invention also has for its object an oven for practicing the control process, of the type comprising a chamber supplied with a source of hyperfrequency energy forming the heating source, an infrared detector remotely measuring the surface temperature of the food product, and control means for the duration of reheating and/or cooking, characterized in that said control means are connected to the infrared detector to receive measurements of surface temperature over a measuring interval and comprise a computing module for the value $S_{Zc}$ of the integral over said interval of the measurements of temperature taken as an absolute value, and of the residual time $t_r$ for reheating and/or cooking according to said prememorized polynomial equation, said control means delivering a control signal to stop the supply of the hyperfrequency energy source when the residual time $t_r$ has elapsed.

The invention as well as the advantages it provides will be better understood from the following description of an embodiment of the process in a microwave oven described with reference to the accompanying drawings, in which:

BRIEF DESCRIPTION ON DRAWINGS

DETAILED DESCRIPTION OF DRAWING

Figure 1:
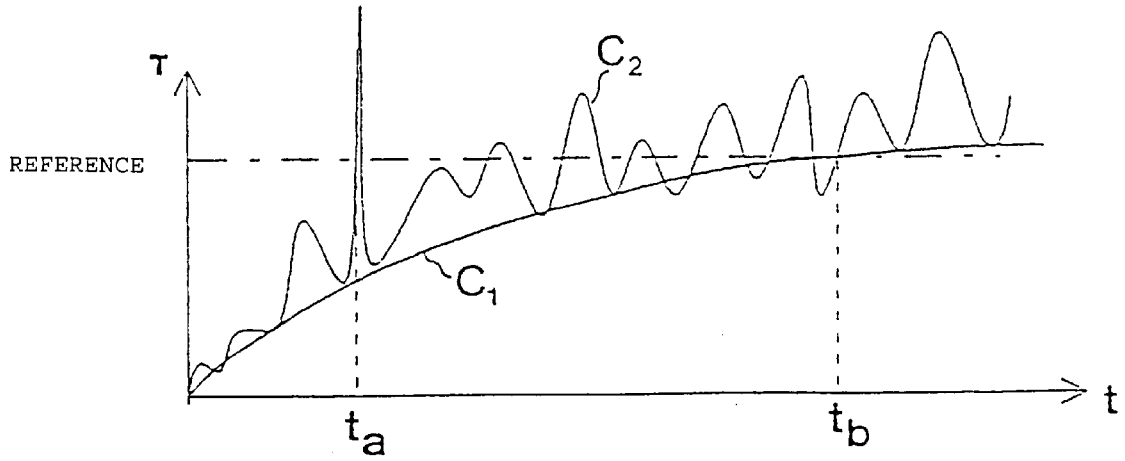
FIG. 1 shows on the one hand the theoretical development (curve $C_1$), and on the other hand the actual development (curve $C_2$) of the surface temperature of a food product of a given type as a function of time.
Figure 2:
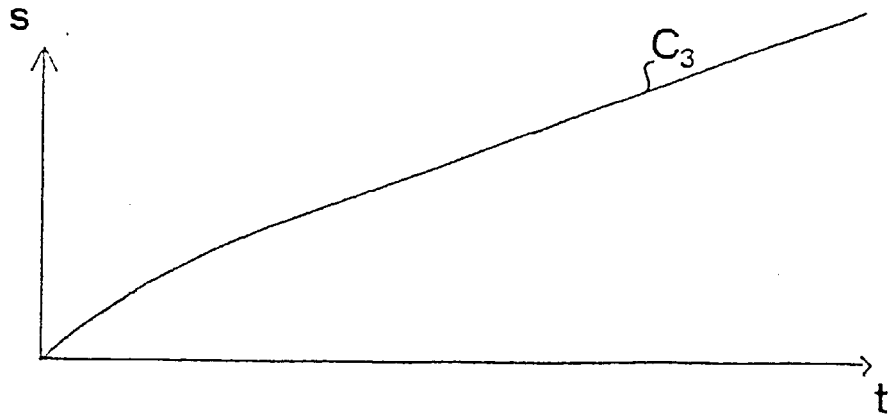
FIG. 2 shows the development with time of the surface S located between the curve $C_2$ of FIG. 1 and the time axis.

As explained above with reference to FIG. 1, the characteristic signal measured by the detector for example the surface temperature of the food in the case of FIG. 1, can be subject to large fluctuations. The originality of the invention resides in the fact that it pays attention not to the development of the instantaneous value of the surface temperature given by the curve $C_2$, but to the development in the course of time of the surface S engendered by the curve $C_2$, located between this curve $C_2$ and the time axis t. The curve $C_3$ shown in FIG. 2 represents the development of this surface. As will be seen, the surface S, which corresponds mathematically to each instant t at the integral with time of the temperature values taken as an absolute value, is a strictly regular increasing function with time, no matter what its fluctuations actually with temperature.

It is necessary, to obtain this surface, to take measurements of the characteristic signal in absolute values. Thus, in the case of reheating a frozen product, the measurements are negative at the outset of the reheating cycle, then become positive.

According to this arrangement, tests carried out by the applicant have permitted showing that it is possible, for an unknown quantity of food product of a given type to be reheated and/or cooked, to connect the value of the surface S at a given instant to the residual time value necessary to obtain optimum reheating and/or cooking, according to a prememorized polynomial equation, as a function of the type of food product.

The process according to the invention therefore consists in carrying out the minimum following steps, described with reference to FIG. 3:

Step A: Once the quantity Z of product of given type has been placed in the chamber of the oven, the heating source is supplied at an initial instant $t_0$, so that it delivers a predetermined fixed power $P_0$.

Step B: There are carried out a plurality of successive measurements of the characteristic signal $T_{car}(t)$, for example of the surface temperature of the food product, until a final instant $t_c$. The measurements can be performed continuously. As a modification, only several samples are taken at a selected frequency.

Step C: The integral of the measured values, taken as absolute values, are calculated. The integral will be referred to in what follows as $s_{Zc}$ to indicate that it is a function of the quantity Z of the food product, and that it is calculated over a time interval up to $t_c$. If only samples are taken, the integral is in fact a sum in the sense of integration of the samples taken in absolute value.

Step D: The residual time $t_r$ is computed by applying the prememorized polynomial equation and as a function of the type of food product. It will be noted that the knowledge of this residual time $t_r$ permits obtaining the total time $t_Z$ necessary for cooking the quantity Z by adding to $t_r$ the time $t_c$.

Step E: The supply of the heating source is stopped when the calculated residual time $t_r$ has elapsed.

Figure 3:
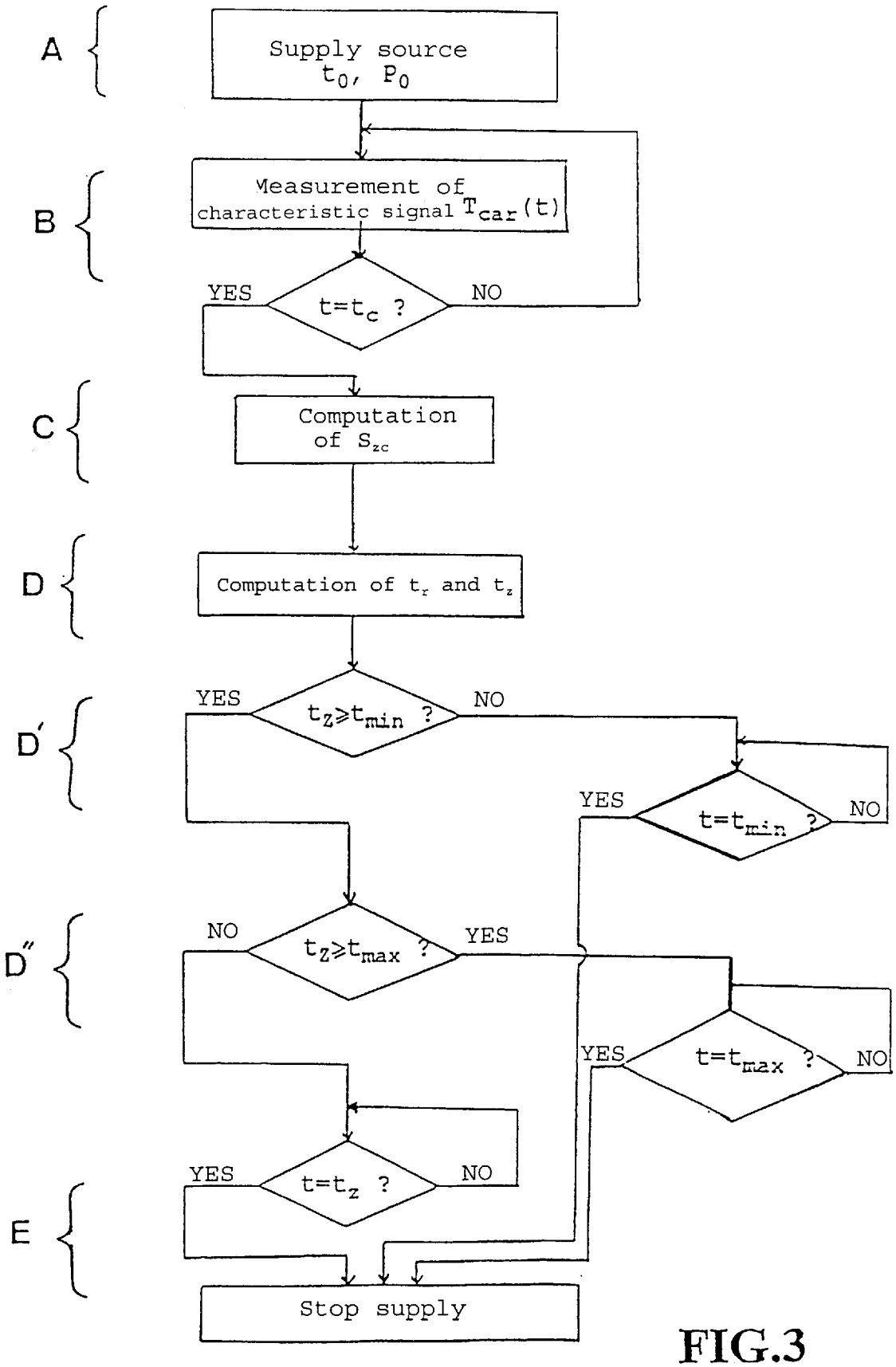
FIG. 3 shows a synopsis of the steps of the control process according to the invention in the operative phase.

The operating synopsis as shown in FIG. 3 moreover comprises two other steps D' and D" which will be explained later.

The polynomial equation used is preferably established experimentally from a preliminary phase of operation of the oven, by carrying out for example the following steps:

Two distinct quantities X and Y of the food product of a given type are selected. Let it be supposed in what follows that the first quantity X is smaller than the second quantity Y.

For each of the quantities X and Y, there is carried out a reheating and/or cooking operation by supplying the heating source such that it delivers power $P_0$ and there is carried out, over the measurement interval from the initial instant $t_0$ to the instant $t_c$, successive measurements of the characteristic signal, and the corresponding integrals $S_{Xc}$ and $S_{Yc}$ are computed.

For each of the quantities X and Y, the total durations $t_x$ and $t_y$ necessary to obtain optimum reheating and/or cooking of the food product in question, are measured.

It can be thus shown that it is possible, for no matter quantity Z of food product of the same type, to compute, at the end of time $t_c$ from the beginning of the cooking and/or reheating operation, the residual time $t_r$ by using, during Step D described above, the linear relation:

$$t_r = \frac{t_X - t_Y}{S_{Xc} - S_{Yc}} S_{Zc} + \frac{t_y S_{Xc} - t_X S_{Yc}}{S_{Xc} - S_{Yc}} \quad \text{(I)}$$

The total duration of reheating and/or cooking for the quantity Z is thus given by the relation:

$$t_Z = t_r + t_c$$

namely $$t_z = \frac{t_X(S_{Zc} - S_{Yc}) - t_y(S_{Zc} - S_{Xc}) + t_c(S_{Xc} - S_{Yc})}{S_{Xc} - S_{Yc}} \quad \text{(II)}$$

Preferably, the final instant $t_c$, corresponding to the upper limit of the measurement interval over which integration is carried out, is selected for each type of food product adapted to be reheated and/or cooked in the oven.

The polynomial equation for a given type of foodstuff also depends preferably on the power delivered by the heating source and selected by the user.

In this way, during the preliminary phase of completing the oven, before the sale of this oven, the manufacturer establishes a library of polynomial equations which are functions of the type of foodstuff and of the power. In the operational phase, the user selects only the type of foodstuff and the heating power. These two data suffice to determine the time $t_c$ at the end of which the integration of the measurements will be made and to select the associated polynomial equation permitting defining the residual time $t_r$ and the total duration $t_Z$.

In a preferred modification of the process according to the invention, it is also provided that the heating source will operate at the power $P_0$ for a minimum predetermined time $t_{min}$, which is a function preferably of the type of fluid product. Thus, a supplemental Step D' (FIG. 3) consists in identifying these abnormal cases in which the total duration $t_Z$ calculated during Step D is less than the minimum duration $t_{min}$, and stopping the supply only when the minimum duration has elapsed.

The minimum duration $t_{min}$ can be determined experimentally during the preliminary phase of work on the oven by selecting, for the first quantity X of a food product of given type, the least quantity of product adapted to be cooked and/or reheated in the oven. The total duration $t_x$ necessary for reheating and/or cooking said quantity X is measured during the preliminary phase corresponding then to the minimum duration of cooking $t_{min}$.

As a modification, if the quantities X and Y have been selected in any manner whatsoever, however respecting the condition according to which the quantity X is lower than the quantity Y, there is carried out, during the preliminary phase of supply of the oven, a reheating and/or cooking operation on a third quantity W corresponding to the least quantity of food product adapted to be cooked and/or reheated, and there is calculated for this quantity W the integral $S_{Wc}$ of the temperature measurements taken as an absolute value and carried out over the measurement interval $t_0$ to $t_c$, and there is calculated the duration $t_{min}$ by use of the equation (II), namely:

$$t_W = t_{\min} = \frac{t_X(S_{\max} - S_{Yc}) - t_Y(S_{\max} - S_{Xc}) + t_c(S_{Xc} - S_{Yc})}{S_{Xc} - S_{Yc}}$$

wherein $S_{max}=S_{Wc}$

Moreover, the process according to the invention can also be used to cause the heating source to operate at the power $P_0$ for a predetermined maximum duration $t_{max}$, as a function preferably of the type of food product. Thus, a supplemental Step D" (FIG. 3) consists in identifying the abnormal cases in which the total duration $t_Z$ calculated during the Step D is greater than the maximum duration $t_{ma}$x, and in stopping the supply as soon as the maximum duration has elapsed, and this even if the residual temperature $t_r$ calculated in Step D has not yet passed. This guarantees safety of operation for the user.

As also in the case of minimum duration, the maximum duration $t_{max}$ can be determined experimentally during the final factory phase by selecting, for the second quantity Y of food product of given type, the greatest quantity of product adapted to be cooked and/or reheated in the oven. The total duration $t_Y$ necessary for reheating and/or cooking said quantity Y and measured during the preliminary phase, thus corresponds to the maximum cooking duration $t_{max}$.

As a modification, if the quantities X and Y have been selected in any given manner, however respecting the condition according to which the quantity X is less than the quantity Y, there is carried out, during the preliminary factory phase, a reheating and/or cooking operation of a third quantity W' corresponding to the greatest quantity of food product adapted to be cooked and/or reheated, and there is computed for this quantity W" the integral $S_{W"c}$ of the temperature measurements taken as absolute values and carried out over the measuring interval $t_0$ to $t_c$, and the duration $t_{max}$ is computed by use of formula (II), namely:

$$t_{W'} = t_{\max} = \frac{t_X(S_{\min} - S_{Yc}) - t_Y(S_{\min} - S_{Xc}) + t_c(S_{Xc} - S_{Yc})}{S_{Xc} - S_{Yc}}$$

wherein $S_{min}=S_{W'c}$

Figure 4:
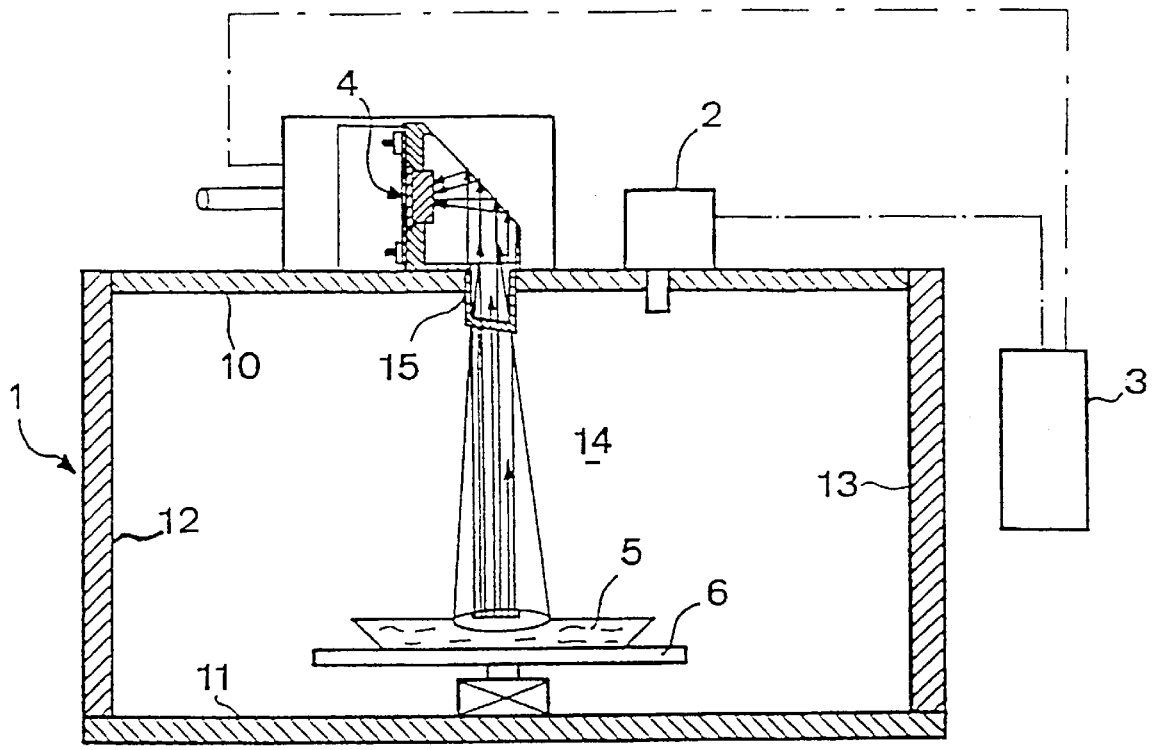
FIG. 4 shows schematically a front cross-sectional view of a microwave oven using the process of the invention.

An example of an oven using the process according to the invention will now be described with reference to FIG. 4:

The microwave oven shown by way of non-limiting example in FIG. 4 comprises a cooking chamber 1 delimited by an upper wall 10, a lower wall 11, two sidewalls 12, 13 and a back wall 14. A heating source comprising a source of hyperfrequency energy 2 of the magnetron type located outside the chamber supplies the interior of the cooking chamber 1 with microwave energy. The supply of the heating source is controlled by control means 3 according to the process of the present invention. An infrared detector 4, disposed for example above the top wall 10, permits detecting, through an opening 15 in the wall 10, the infrared radiation from the food product 5 of any type disposed within the cooking chamber 1, for example on a plate 6 rotated by an electric motor (not shown), when the control means 3 permits supply of the heating source 2. The detector 4 thus carries out measurements of the surface temperature of the food product.

According to the invention, the detector 10 is controlled by control means 3 to carry out measurements of the surface temperature of the foodstuff over the measurement interval $t_0$ to $t_c$. The control means comprise also a computing module determining the different computations on the one hand, of the integral $S_{Zc}$, and on the other hand, the residual time $t_r$ and the total time $t_Z$. When the residual time has elapsed, the control means 3 will deliver a control signal permitting stopping the supply of the energy source. The control means can be embodied by a microprocessor comprising a memory to store a plurality of polynomial equations, and a clock to io control the running of the times.

The new control process according to the invention permits achieving two objectives:

Improving the results of reheating and/or cooking of the food products;

Giving the user sufficiently early in the reheating and/or cooking cycle, an idea of the residual operating time, by using only the characteristic signal.

Moreover, in the particular application to a microwave oven, there can be carried out a reheating and/or cooking operation at constant power.

The invention can also be applied to any type of heating energy source, and to any type of detector adapted to give information on the condition of reheating and/or cooking of a food product.

What is claimed is:

1. Process for controlling the duration of reheating and/or cooking of an undetermined quantity Z of a food product (5) of given type disposed in the chamber (1) of an oven comprising a heating source (2) and a detector (4) for a signal $T_{car}(t)$ characteristic of the state of reheating and/or cooking of the food product, characterized in that it consists in:

(A) supplying said heating source (2) at an initial instant $t_0$ such that it delivers a constant predetermined power $P_0$;

(B) measuring said characteristic signal $T_{car}(t)$ at a plurality of successive instants t over a measurement interval extending from said initial instant $t_0$ to a final predetermined instant $t_c$, and (C) computing over this measuring interval the value $S_{Zc}$ of the integral of the measurements of the characteristic signal taken as an absolute value;

(D) determining the residual time $t_r$ for reheating and/or cooking for said indeterminate quantity Z of foodstuff according to a predetermined and memorized polynomial equation relating said residual time $t_r$ to the value $S_{Zc}$ of the integral calculated as a function of said type of food product; and (E) stopping the supply of the heating source when the residual time $t_r$ has passed.

2. Control process according to claim 1, characterized in that the residual time $t_r$ is computed by using the following polynomial equation:

$$t_r = \frac{t_X - t_Y}{S_{Xc} - S_{Yc}} S_{Zc} + \frac{t_y S_{Xc} - t_X S_{Yc}}{S_{Xc} - S_{Yc}}$$

in which $t_r$ represents said residual time;

$s_{Zc}$ represents the calculated value of the integral;

$S_{Xc}$ and $S_{Yc}$ are values of integrals over measurements of characteristic signals taken as an absolute value and carried out, in a preliminary factory phase for the oven, over said measuring interval upon reheating and/or cooking at said power $P_0$ respectively of a first quantity X and a second quantity Y of said food product of given type, the second quantity Y being greater than the first quantity X; and $t_X$ and $t_Y$ are total necessary reheating and/or cooking durations, measured in said preliminary phase, in the case respectively of the first quantity X and the second quantity Y.

3. Control process according to any one of the claim 1, characterized in that it provides (D", E) stopping the supply of the heating source before the residual time $t_r$ has elapsed as soon as the duration of operation of the oven from the initial instant $t_0$ becomes equal to the predetermined maximum utilization duration $t_{max}$.

4. Control process according to claim 3, characterized in that the maximum utilization duration $t_{max}$ is predetermined for each type of food product adapted to be reheated and/or cooked in the oven.

5. Control process according to claim 4, characterized in that, for a given type of food product, the maximum duration $t_{max}$ for use of the oven is determined experimentally by selecting, for the second quantity Y of food product, the greatest quantity of said product adapted to be reheated and/or cooked in the oven, the total duration $t_y$ necessary for reheating and/or cooking of this second quantity and measured during said preliminary phase corresponding to said maximum duration $t_{max}$.

6. Control process according to claim 4, characterized in that for a given type of food product, the maximum duration $t_{max}$ of use of the oven is determined by computing the relationship $$t_{\max} = \frac{t_X(S_{\min} - S_{Yc}) - t_Y(S_{\min} - S_{Xc}) + t_c(S_{Xc} - S_{Yc})}{S_{Xc} - S_{Yc}}$$

in which $S_{min}$ is the value of the integral over measurements of the characteristic signal taken as an absolute value and effected in the preliminary factory phase of the oven over said measuring interval during reheating and/or cooking at said power $P_0$ of the greatest quantity of food product of the given type adapted to be reheated and/or cooked in the oven.

7. Control process according to claim 1, characterized in that the final instant $t_c$ corresponding to the upper limit of the interval of measurement is selected for each type of food product adapted to be reheated and/or cooked in the oven.

8. Control process according to claim 2, characterized in that it also includes (D", E) operating the supply of the heating source (2) for a minimum duration $t_{min}$ for a given type of food product from said initial instant $t_0$ the minimum duration $t_{min}$ being determined experimentally by selecting, for the first quantity X of food product, the smallest quantity of said product adapted to be reheated and/or cooked in the oven, the total duration $t_X$ necessary for reheating and/or cooking for this second quantity and measured during said preliminary phase corresponding to said minimum duration $t_{min}$.

9. Control process according to claim 1, characterized in that the characteristic signal $t_{car}(t)$ of the state of reheating and/or cooking of the food product is constituted by a measurement of the surface temperature of the food product.

10. Oven for practicing the control process according to claim 1, of the type comprising a chamber (1) supplied by a source of hyperfrequency energy (2) forming the heating source, an infrared detector (4) remotely measuring the surface temperature of the food product, and control means (3) of the duration of reheating and/or cooking, characterized in that said control means (3) are connected to the infrared detector (4) to receive measurements of surface temperature over a measuring interval and comprising a module for computing the value $S_{Zc}$ of the integral over said interval of the measurements of temperature taken as an absolute value, and of the residual time $t_r$ for reheating and/or cooking according to said prememorized polynomial equation, said control means (3) delivering a control signal to stop the supply of the hyperfrequency energy source (2) when the residual time $t_r$ has elapsed.

* * * * *